US012378748B2

(12) United States Patent
Chaillou

(10) Patent No.: US 12,378,748 B2
(45) Date of Patent: Aug. 5, 2025

(54) LOAD-HANDLING VEHICLE

(71) Applicant: MANITOU BF, Ancenis (FR)

(72) Inventor: Vincent Chaillou, Ancenis (FR)

(73) Assignee: MANITOU BF, Ancenis (FR)

( * ) Notice: Subject to any disclaimer, the term of this patent is extended or adjusted under 35 U.S.C. 154(b) by 443 days.

(21) Appl. No.: 17/612,998

(22) PCT Filed: May 12, 2020

(86) PCT No.: PCT/FR2020/050785
§ 371 (c)(1),
(2) Date: Nov. 19, 2021

(87) PCT Pub. No.: WO2020/245518
PCT Pub. Date: Dec. 10, 2020

(65) Prior Publication Data

US 2022/0205214 A1 Jun. 30, 2022

(30) Foreign Application Priority Data

Jun. 3, 2019 (FR) ..... 19 05870

(51) Int. Cl.
*E02F 3/43* (2006.01)
*E02F 3/28* (2006.01)
(Continued)

(52) U.S. Cl.
CPC ..... *E02F 3/431* (2013.01); *E02F 3/283* (2013.01); *E02F 9/2004* (2013.01);
(Continued)

(58) Field of Classification Search
CPC ..... E02F 3/431; E02F 3/283; E02F 9/2004; E02F 9/2246; E02F 9/264; E02F 9/2253
See application file for complete search history.

(56) References Cited

U.S. PATENT DOCUMENTS

2003/0070859 A1* 4/2003 Dahl ..... B60K 31/10 180/305
2009/0111655 A1* 4/2009 Hatanaka ..... B60W 30/1888 477/218
(Continued)

FOREIGN PATENT DOCUMENTS

CN 1668835 9/2005
CN 101287899 10/2008
(Continued)

OTHER PUBLICATIONS

Chinese office action dated Jul. 1, 2022.
International Search Report dated Sep. 1, 2020.

*Primary Examiner* — Khoi H Tran
*Assistant Examiner* — Dairon Estevez
(74) *Attorney, Agent, or Firm* — IPSILON USA, LLP

(57) ABSTRACT

The invention relates to a load-handling vehicle (1) comprising a wheeled chassis (2) and, supported by said chassis (2),—an internal combustion engine (4),—a mechanism (5) for transmitting power from the internal combustion engine (4) to the wheels (3) of the chassis (2),—a bucket (7),—a system for moving said bucket (7),—a control unit (9),—an accelerator pedal (10),—a control member (11) which can be manually actuated by the driver of the vehicle,—a system (12) for detecting movements of the bucket (7). The power transmission mechanism (5) is configured so that a reduction in the rotational speed of the internal combustion engine (4) results in a reduction in the torque supplied to the wheels (3) of the chassis (2) and the vehicle (1) comprises at least one operating mode in which the control unit (9) is configured, in accordance with the data provided by the system (12) for detecting the movements of the bucket (7) and the control instructions of the system for moving the bucket (7), to reduce the rotational speed of the engine (4) to a value lower
(Continued)

than the set value for speed control corresponding to the position of the accelerator pedal (10).

7 Claims, 3 Drawing Sheets

(51) Int. Cl.
*E02F 9/20* (2006.01)
*E02F 9/22* (2006.01)
*E02F 9/26* (2006.01)

(52) U.S. Cl.
CPC ..... *E02F 9/2246* (2013.01); *E02F 9/2253* (2013.01); *E02F 9/264* (2013.01)

(56) References Cited

U.S. PATENT DOCUMENTS

2013/0259620 A1* 10/2013 Shirao ..... E02F 9/2253 701/50
2014/0058649 A1* 2/2014 Miyasaka ..... F02D 29/00 701/110
2014/0190153 A1* 7/2014 Britten ..... F16H 61/433 701/50
2015/0139767 A1* 5/2015 Moriki ..... E02F 3/431 414/699
2017/0089044 A1* 3/2017 Chitty ..... G01M 5/0033
2018/0080193 A1* 3/2018 Myers ..... E02F 9/262
2018/0142442 A1 5/2018 Tsuji
2018/0171590 A1 6/2018 Kean
2018/0171594 A1 6/2018 Tsuji et al.

FOREIGN PATENT DOCUMENTS

CN 109154152 1/2019
EP 3342936 7/2018
EP 3358087 8/2018
JP 2001271372 10/2001

* cited by examiner

LOAD-HANDLING VEHICLE

RELATED APPLICATIONS:

This application is a National Phase of PCT/FR2020/050785 filed on May 12, 2020, which claims the benefit of priority from French Patent Application No. 19 05870, filed on Jun. 3, 2019, the entirety of which are incorporated by reference.

FIELD OF THE INVENTION:

The invention relates to a load-handling vehicle.

It relates in particular to a load-handling vehicle comprising a wheeled chassis, and, supported by said chassis,

- an internal combustion heat engine,
- a power transmission mechanism configured to transmit the power of the heat engine to the wheels of the chassis,
- a bucket,
- a system for driving the movement of said bucket,
- a control unit,
- an accelerator pedal, the control unit being configured to generate a rotation speed control setpoint for the heat engine as a function of the position of the accelerator pedal,
- a control member, such as a joystick, that can be manually actuated by the driver of the vehicle, the control unit being configured to generate control setpoints for the system for driving the movement of the bucket as a function of the actuation of the control member,
- a system for detecting the movements of the bucket with respect to the chassis configured to deliver, to the control unit, data representative of the movements of the bucket with respect to the chassis and/or to the system for driving the movement of the bucket.

DESCRIPTION OF RELATED ART:

It should be noted, moreover, that solutions for lowering the engine speed despite actuation of the accelerator pedal in order to optimize the operation of the bucket handling device are known, as the document US 2009/111655 illustrates.

Likewise, solutions for detecting the position of the bucket are known as the document EP 3342936 illustrates.

Such a load-handling vehicle is known, as illustrated for example by the patent application EP3358087. Such a load-handling vehicle is very often used to transport loose material stored in heaps from the heap to a bin, in order to load said bin with material. In practice, when an operator wants to perform such an operation of filling of his or her bucket with a material stored in a heap in order to offload it at another point, the reflex of the operator is to advance at full power into the heap to fill the bucket as much as possible in one go, and therefore to gain productivity. The operator then seeks, by keeping his or her foot on the accelerator pedal, to simultaneously perform bucket digging and arm lifting operations to finish filling his or her bucket and to depart with the bucket filled to the maximum. However, this simultaneous action of advance and of movement of the bucket does not necessarily translate into extraction of the material from the heap. Faced with this situation, when the vehicle no longer advances (wheels blocked or skidding), and, despite the arm lifting and/or bucket digging commands, the system for driving the movement of the bucket is not able to lift the bucket, the reflex of the operator is to press even harder on the accelerator pedal. The result thereof is a premature wear of the tires resulting from the skidding of the wheels, an excessive fuel consumption, a significant stressing of the mechanics with a high risk of damage to these mechanics and an absence of optimization of the bucket loading times.

OBJECTS AND SUMMARY:

One aim of the invention is to propose a handling vehicle of the abovementioned type whose design makes it possible to optimize the times for loading the bucket with a material stored in a heap while preserving the mechanics and the tires of the vehicle.

Another aim of the invention is to propose a handling vehicle of the abovementioned type whose design makes it possible to optimize the bucket loading times without compromising the fuel consumption of the vehicle.

To this end, the subject of the invention is a load-handling vehicle comprising a wheeled chassis, and, supported by said chassis,

- an internal combustion heat engine,
- a power transmission mechanism configured to transmit the power of the heat engine to the wheels of the chassis,
- a bucket,
- a system for driving the movement of said bucket,
- a control unit,
- an accelerator pedal, the control unit being configured to generate a rotation speed control setpoint for the heat engine as a function of the position of the accelerator pedal,
- a control member, such as a joystick, that can be manually actuated by the driver of the vehicle, the control unit being configured to generate control setpoints for the system for driving the movement of the bucket as a function of the actuation of the control member,
- a system for detecting the movements of the bucket with respect to the chassis and/or to the system for driving the movement of the bucket configured to deliver data representative of the movements of the bucket with respect to the chassis and/or to the system for driving the movement of the bucket to the control unit, characterized in that the power transmission mechanism is configured such that a reduction of the speed of rotation of the heat engine results in a lowering of the torque supplied to the wheels of the chassis and in that the vehicle comprises at least one mode of operation in which the control unit is configured to, as a function of the data supplied by the system for detecting the movements of the bucket and of the control setpoints of the system for driving the movement of the bucket, reduce the speed of rotation of the internal combustion heat engine to a value lower than the speed control setpoint value corresponding to the position of the accelerator pedal. The control unit is therefore configured to reduce the speed of rotation of the heat engine to a speed lower than the speed control setpoint value corresponding to the position of the accelerator pedal when the detected movements of the bucket do not conform to the control movements of the bucket. By virtue of this design, it is possible to reduce the thrusting force of the vehicle in the heap of material independently of an accelerator demand from the operator. The reduction in thrusting force makes it possible to reduce the strain on or the friction of the bucket against the heap, this strain or this friction being able to oppose the digging or tipping-out movement of the bucket. The value of the speed of rotation of the heat engine is not necessarily that corresponding to the speed control setpoint value corresponding to the position of the accelerator pedal such that the operator can keep his or her foot on the accelerator, or even accelerate more, without the thrusting force of the vehicle in the heap being increased. Thus, no training of the operator is necessary to require him or her to modify his or her behavior with respect to the manipulation of the accelerator pedal. This reduction of the thrusting force can, also, depending on the design of the vehicle, be applied in favor of the extraction force obtained by movement of the bucket. Finally, this design makes it possible to preserve the vehicle and reduce the fuel consumption of the vehicle while optimizing the bucket loading times.

According to one embodiment of the invention, the control unit is configured to determine, as a function of the control setpoints of the system for driving the movement of the bucket, the actuation of the control member in the direction of a movement of the bucket and to determine, as a function of the data supplied by the system for detecting the movements of the bucket, a movement or an absence of movement of the bucket, and the control unit is configured to reduce the speed of rotation of the internal combustion heat engine to a value lower than the speed setpoint value corresponding to the position of the accelerator pedal, when an absence of movement of the bucket is determined by the control unit when the control member is in the actuated state in the direction of a movement of the bucket. The control unit is therefore configured to reduce the speed of rotation of the heat engine to a value lower than the speed control setpoint value corresponding to the position of the accelerator pedal, when an absence of a movement of the bucket is determined when the control member of the system for driving the movement of the bucket is in the actuated state.

According to one embodiment of the invention, the control unit is configured to determine, as a function of the control setpoints of the system for driving the movement of the bucket, a theoretical travel of movement of the bucket when the control member is in the actuated state and to determine, as a function of the data supplied by the system for detecting the movements of the bucket, a real travel of movement of the bucket, the control unit being configured to compare the theoretical and real values of travel of movement of the bucket and to reduce the speed of rotation of the heat engine to a value lower than the speed control setpoint value corresponding to the position of the accelerator pedal as a function of the comparison result. The control unit is therefore configured to reduce the speed of rotation of the heat engine to a value lower than the speed control setpoint value corresponding to the position of the accelerator pedal when the real travel of movement of the bucket is less than the theoretical travel of movement of the bucket.

According to one embodiment of the invention, the control unit is configured to determine, as a function of the control setpoints of the system for driving the movement of the bucket, a theoretical speed of movement of the bucket when the control member is in the actuated state and to determine, as a function of the data supplied by the system for detecting the movements of the bucket, a real speed of movement of the bucket, the control unit being configured to compare the theoretical and real values of speed of movement of the bucket and to reduce the speed of rotation of the heat engine to a value lower than the speed control setpoint value corresponding to the position of the accelerator pedal as a function of the comparison result. The control unit is therefore configured to reduce the speed of rotation of the heat engine to a value lower than the speed control setpoint value corresponding to the position of the accelerator pedal when the real speed of movement of the bucket is less than the theoretical speed of movement of the bucket.

According to one embodiment of the invention, the control unit is configured to determine, as a function of the control setpoints of the system for driving the movement of the bucket, a theoretical acceleration of movement of the bucket when the control member is in the actuated state and to determine, as a function of the data supplied by the system for detecting the movements of the bucket, a real acceleration of movement of the bucket, the control unit being configured to compare the theoretical and real values of acceleration of movement of the bucket and to reduce the speed of rotation of the heat engine to a value lower than the speed control setpoint value corresponding to the position of the accelerator pedal as a function of the comparison result. The control unit is therefore configured to reduce the speed of rotation of the heat engine to a value lower than the speed control setpoint value corresponding to the position of the accelerator pedal when the real acceleration of movement of the bucket is less than the theoretical acceleration of movement of the bucket.

According to one embodiment of the invention, the power transmission mechanism is a hydrodynamic power transmission mechanism which comprises a torque converter.

According to one embodiment of the invention, the vehicle comprises a position selector with at least two positions, namely a forward control position and a reverse control position, the control member has a neutral position, and the mode of operation in which the control unit is configured to, as a function of the data supplied by the system for detecting the movements of the bucket and of the control setpoints of the system for driving the movement of the bucket, reduce the speed of rotation of the heat engine to a value lower than the value delivered by the accelerator pedal is an activatable/deactivatable mode, said mode of operation being deactivated when the position selector is in the reverse control position and the control member is in the neutral position.

According to one embodiment of the invention, the system for driving the movement of the bucket comprises a hydraulic part linked to the internal combustion heat engine. The system for driving the movement of the bucket uses, in its hydraulic part, the power of the heat engine. A lowering of the engine speed is generally favorable to the system for driving the movement of the bucket because of the distribution of the engine power which is applied between the system for driving the movement of the bucket and the power transmission mechanism configured to transmit the power of the heat engine to the wheels of the chassis. In fact, the ratio of thrusting force of the vehicle on the heap when it enters into the heap/force of movement of the bucket in the digging or tipping-out direction tends to decrease when the engine speed is lowered, which favors the driving of the movement of the bucket over the advancing of the vehicle, this result being desired when the bucket is being loaded in the heap.

According to one embodiment of the invention, the system for driving the movement of the bucket comprises at least one arm disposed between the chassis and the bucket, this arm being equipped with at least one first actuator for driving the movement of the arm with respect to the chassis and at least one second actuator for driving the movement of the bucket with respect to the arm between a digging position of the bucket and a tipping-out position, said actuators being linked to a hydraulic pump coupled to the internal combustion heat engine. Thus, the pump and the actuators form the hydraulic part of the system for driving the movement of the bucket.

According to one embodiment of the invention, the system for detecting the movements of the bucket with respect to the chassis configured to deliver data representative of the movements of the bucket with respect to the chassis and/or with respect to the system for driving the movement of the bucket to the control unit comprises at least one sensor of the position of the arm with respect to the chassis and one sensor of the position of the bucket with respect to the arm.

BRIEF DESCRIPTION OF THE DRAWINGS

The invention will be well understood on reading the following description of exemplary embodiments, with reference to the attached drawings in which.

Figure 1:
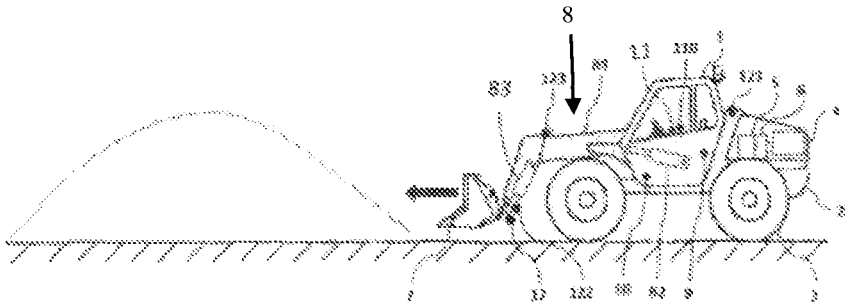
FIG. 1 represents a schematic view of a handling vehicle according to the invention ready to enter into a heap of loose material to load the bucket of the vehicle.
Figure 2:
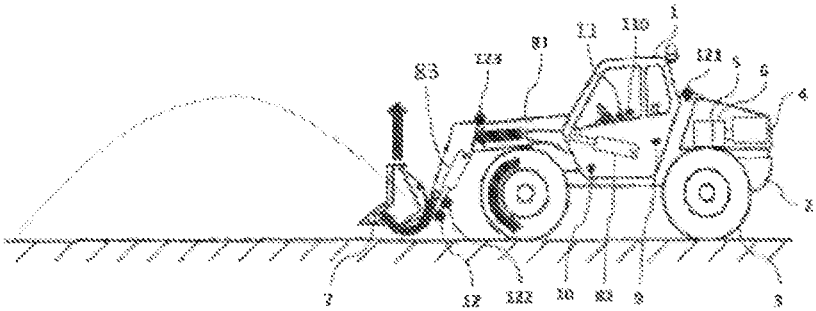
FIG. 2 represents a schematic view of a handling vehicle, according to the invention, entered into a heap of loose material in the state with the bucket controlled to move to load the bucket of the vehicle.
Figure 3:
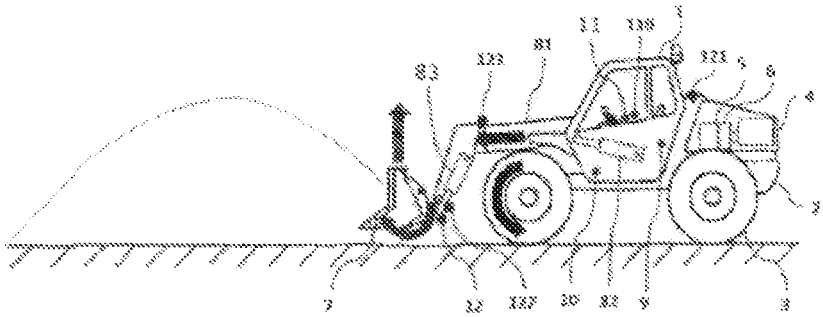
FIG. 3 represents a schematic view of a handling vehicle, according to the invention, entered into a heap of loose material, in the state with the bucket controlled to move to load the bucket of the vehicle during the phase of comparison of the detected movements of the bucket and of the controlled movements of the bucket.
Figure 4:
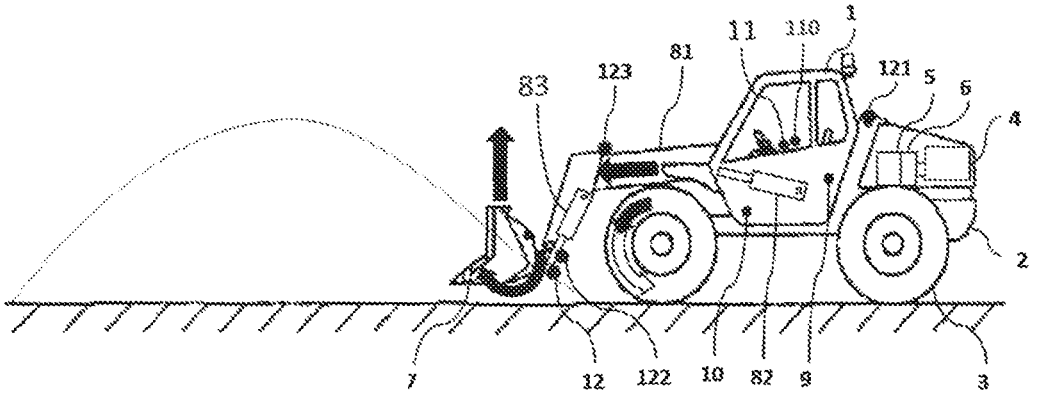
FIG. 4 represents a schematic view of a handling vehicle, according to the invention, entered into a heap of loose material, in the state with the bucket controlled to move to load the bucket of the vehicle, during the phase of reduction of the engine speed to limit the force applied on the wheels and consequently on the bucket, the detected movements of the bucket not conforming to the controlled movements.
Figure 5:
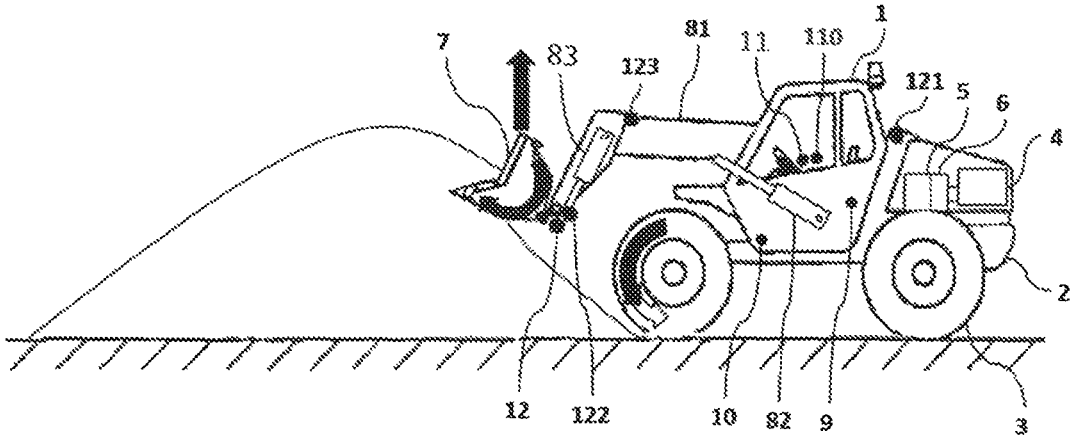
FIG. 5 represents a schematic view of a handling vehicle, according to the invention, entered into a heap of loose material, in the state with the bucket controlled to move to load the bucket of the vehicle, during the phase of increasing of the engine speed to obtain a speed of rotation of the engine equal to the speed control setpoint corresponding to the position of the accelerator pedal when the detected movements of the bucket conform to the controlled movements.
Figure 6:
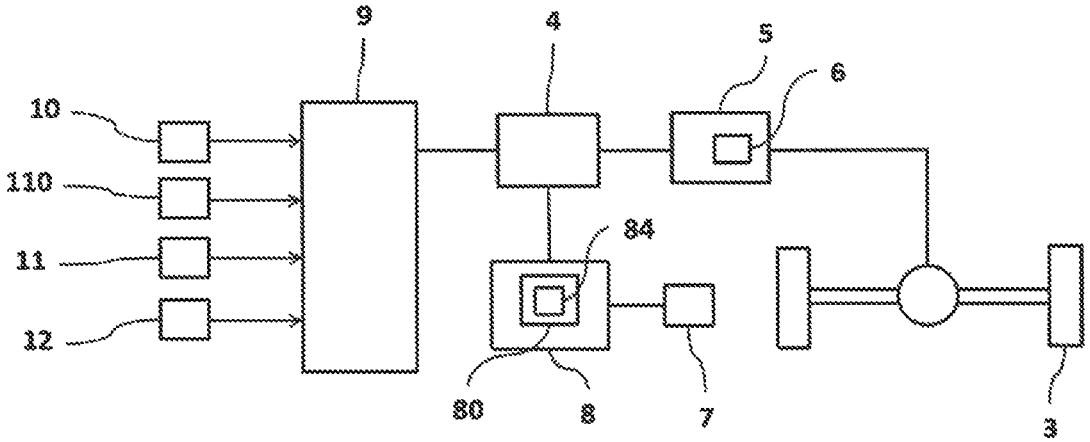
FIG. 6 represents a block diagram of components of the vehicle.

DETAILED DESCRIPTION:

As mentioned above, the subject of the invention is a load-handling vehicle 1 with bucket 7 used notably on worksites for the handling and transportation of loose materials stored in heaps as in the examples represented.

This vehicle 1 comprises a wheeled chassis 2 equipped with wheels 3, generally four of them. This wheeled chassis 2 supports a driver cabin inside which the driver of the vehicle can sit. This wheeled chassis 2 also supports an internal combustion heat engine 4 and a power transmission mechanism 5 configured to transmit the power of the heat engine 4 to the drive wheels 3 of the vehicle.

Generally, this transmission mechanism 5 is configured such that a reduction of the speed of rotation of the heat engine 4 results in a lowering of the torque supplied to the wheels 3 of the chassis 2. In practice, the power transmission mechanism 5 is a hydrodynamic power transmission mechanism which comprises a torque converter 6.

Thus, the heat engine 4 is, at the output, coupled via, for example, a universal joint link and an angle transmission to the torque converter 6 which, itself, is linked at the output via a gearbox to the axle at the ends of which the wheels 3 of the vehicle 1 are disposed.

The hydrodynamic torque converter 6 can be composed of a pump wheel on the side on which the engine 4 is driven by the engine shaft and a turbine wheel on the output side, and, preferably, an annular distributor between the two.

A torque converter 6 such as that marketed under the tradename Sachs model ZF can be used.

The wheeled chassis 2 also supports a system 8 for driving the movement of the bucket 7. Conventionally, the system 8 for driving the movement of the bucket 7 comprises a hydraulic part 80 linked to the internal combustion heat engine 4. In particular, in the examples represented, the system 8 for driving the movement of the bucket 7 comprises at least one arm 81 disposed between the chassis 2 and the bucket 7, this arm 81 being equipped with at least one first actuator 82 for driving the movement of the arm 81 with respect to the chassis 2 and at least one second actuator 83 for driving the movement of the bucket 7 with respect to the arm 81 between a digging position of the bucket and a tipping-out position, said actuators 82, 83 being linked to a hydraulic pump 84 coupled to the internal combustion heat engine 4.

The hydraulic pump 84 and the hydraulic actuators 82 and 83 form the hydraulic part 80 of the system 8 for driving the movement of the bucket 7.

In the examples represented, the arm 81 is a pivoting arm mounted to pivot about a horizontal axis, parallel to the ground support plane of the vehicle 1, in the configuration of use of the vehicle 1 for the arm 4 to transition from a low position to a high position and vice versa, using the first actuator 82, such as a cylinder, disposed between the arm 81 and the wheeled chassis 2. In the example represented, a single double-acting cylinder is represented, supplied with fluid by the hydraulic pump 84. A pair of single-acting parallel cylinders supplied in turn with fluid would have been able to be used in an equivalent manner.

In the examples represented, the arm 81 is a telescopic arm formed by two arm sections mounted to be slidingly fitted together, and driven in relative movement by an actuator, not represented, for the arm to transition from a retracted position to an extended position and vice versa. As a variant, this arm 81 can be a non-telescopic arm.

The second actuator 83 for driving the movement of the bucket 7 is disposed either between the arm 81 and the bucket 7, or between a bucket-holder with which the end of the arm 81 is equipped and the bucket 7.

Independently of the mounting, this second actuator 83 can once again take the form of a double-acting hydraulic cylinder or a pair of single-acting cylinders. The driving of the movement of the bucket 7 using this second actuator 83 takes place about an axis parallel to the horizontal axis of pivoting of the arm 81 with respect to the chassis 2 to allow the bucket 7 to transition from a digging position to a tipping-out position and vice versa.

The vehicle 1 also comprises, supported by the chassis 2, a control unit 9 and a control member 11, such as a joystick, that can be manually actuated by the driver of the vehicle.

The control unit 9 is configured to generate control setpoints of the system 8 for driving the movement of the bucket 7 as a function of the actuation of the control member 11.

In fact, the supply of fluid to the actuators 82, 83 using the hydraulic pump 84 is controlled as a function of the control setpoints supplied by the control unit 9. These control signals are themselves a function of the input data received by the control unit 9 and resulting from the actuation of the control member 11. The unit 9 comprises, for example, a microcontroller or a microprocessor associated with a memory. Thus, when it is specified that the unit 9 or means of said unit 9 are configured to perform a given operation, that means that said unit 9 comprises computer instructions and corresponding execution means which make it possible to perform said operation.

The control setpoints supplied by the control unit 9 act generally on members, such as a distributor or valve, disposed on the link between the pump 84 and the actuators 82, 83, to allow an appropriate supply of fluid to the actuators 82, 83, as is known.

In the example represented, the control member 11, disposed in the driver cabin, is a control lever also called joystick. This control member 11 is, for example, equipped at its base with two coders to allow the transmission of two position signals from said control member 11 to the control unit 9, as is known. An example of such a control member 11 is for example described in the patent FR 2 858 861. This control member 11 can thus be displaced forward, backward, to the left or to the right of the vehicle. Generally, the movements, forward and backward of the vehicle, of this control member 11 control the up and down movement of the arm 81, whereas the movements, to the left and to the right of the vehicle, of the control member 11 control the pivoting movement of the bucket 7.

These forward/backward and left/right directions correspond to the main directions, and the control member 11 can be driven according to an infinity of directions, the movement of the control member 11 in any direction corresponding to a combined action that is proportional to the position of the control member 11 with respect to the main directions. Generally, this control member 11 is returned by a spring to the neutral position, that is to say into an intermediate position between right/left and front/rear, when it is in the unstressed state.

The position information addressed to the control unit 9 is therefore generally information relating to the angular position of the control member 11, with respect to the position that it occupies in the neutral position.

As mentioned above, to allow such movements of the arm 81 and of the bucket 7 from the control member 11, the control unit 9 controls the supply of hydraulic fluid to the first and second actuators 82 and 83 as a function of the position data supplied by the control member 11. Thus, the first and second actuators are each disposed on a hydraulic circuit equipped with at least one valve or a distributor that can be driven by the control unit 9.

The control unit 9 is, here, produced in the form of a controller or microprocessor in which sets of computer instructions have been implemented to perform the functions of the driver unit. However, the functions of the control unit 9 can be performed by dedicated electronic components or components of FPGA or ASIC type. It is also possible to combine computing parts and electronic parts.

The computer programs or computer instructions can be contained in program storage devices, for example digital data storage media that can be read by computer or executable programs. The programs or instructions can also be executed from program storage peripheral devices.

Generally, the control unit 9 is configured to receive the position signals which are addressed to it by the control member 11 and to transmit output signals to the valves or distributors with which the hydraulic circuits of the first and second actuators are equipped, generally via solenoids with which said valves or distributors are equipped.

The first and second actuators 82, 83 control, as a function of their hydraulic flow supply, a movement of the arm for the first actuator 82 and a movement of the bucket for the second actuator 83.

The vehicle 1 also comprises a system 12 for detecting the movements of the bucket 7 with respect to the chassis 2 and/or to the system 8 for driving the movement of the bucket 7 configured to deliver data representative of the movements of the bucket 7 with respect to the chassis 2 and/or to the system 8 for driving the movement of the bucket 7 to the control unit 9.

In the examples represented, this system 12 for detecting the movements of the bucket 7 comprises at least one sensor 121 of the position of the arm 81 with respect to the chassis 2 and one sensor 122 of the position of the bucket 7 with respect to the arm 81. These position sensors are, here, angular sensors for measuring the angle of inclination formed by the bucket 7 with respect to the arm 81 and the angle of inclination of the arm 81 with respect to the ground support plane of the chassis 2.

In the case of a telescopic arm 81, a sensor 123 for detecting the retraction or the extension of the telescope can also be provided.

All the signals from these sensors are supplied to the control unit 9 which incorporates a clock to allow the reception of these signals as a function of time.

The vehicle 1 also comprises an accelerator pedal 10 disposed in the driver cabin. This accelerator pedal 10 can be equipped with a position sensor and the control unit 9 is configured to generate a control setpoint for the speed of rotation of the heat engine 4 as a function of the position of the accelerator pedal 10. The position of the accelerator pedal 10 can be determined also from sensors disposed at other locations on the acceleration system.

In one mode of operation of the vehicle, the control unit 9 is configured to, as a function of the data supplied by the system 12 for detecting the movements of the bucket 7 and of the control setpoints of the system 8 for driving the movement of the bucket 7, reduce the speed of rotation of the internal combustion heat engine 4 to a value lower than the speed control setpoint value corresponding to the position of the accelerator pedal 10. This mode of operation is activatable/deactivatable.

In particular, the vehicle 1 comprises a position selector 110 with at least two positions, namely a forward control position and a reverse control position and the control member 11 has a neutral position and the mode of operation in which the control unit 9 is configured to, as a function of the data supplied by the system 12 for detecting the movements of the bucket 7 and of the control setpoints of the control member 11, reduce the speed of rotation of the engine 4 to a value lower than the value delivered by the accelerator pedal 10 is an activatable/deactivatable mode. This mode of operation is deactivated when the position selector 110 is in the reverse control position and when the control member 11 is in the neutral position.

To activate this mode of operation when the vehicle is set to forward position, the driver of the vehicle 1 must deliberately actuate a control member, such as knob or the like, disposed in the driver cabin.

Likewise, the position selector 110 is disposed inside the driver cabin and can be supported by the control member 11 in the case where the latter is formed by a joystick.

When the mode of operation is in the activated state, the engine speed can be reduced according to various conditions which can be cumulative or exclusive.

Generally, the control unit 9 is configured to determine, as a function of the control setpoints of the system for driving the movement of the bucket 7, at least one so-called theoretical characteristic of the movement of the bucket, and, as a function of the data supplied by the system 12 for detecting the movement of the bucket 7, at least one real characteristic of the movement of the bucket, and the control unit 9 is configured to compare the theoretical and real values of one and the same characteristic and to reduce the speed of rotation of the heat engine to a value lower than the speed setpoint value corresponding to the position of the accelerator pedal as a function of the result of the comparison.

In particular, the speed is reduced when the theoretical and practical characteristics do not agree or when the theoretical characteristic is of a lower value than the real characteristic. The characteristic of the movement of the bucket can be chosen from the group of characteristics formed by the speed and/or the travel and/or the acceleration of the movement of the bucket, or, more simply, by the absence of a movement of the bucket when the control member 11 is in the actuated state in the direction of a movement of the bucket. These characteristics can be cumulative or not.

Thus, in the simplest version, the control unit 9 is configured to determine, as a function of the control setpoints of the system 8 for driving the movement of the bucket 7, the actuation of the control member 11 in the direction of a movement of the bucket 7 and to determine, as a function of the data supplied by the system 12 for detecting the movements of the bucket 7, a movement or an absence of movement of the bucket 7, and the control unit 9 is configured to reduce the speed of rotation of the internal combustion heat engine to a value lower than the speed setpoint value corresponding to the position of the accelerator pedal when an absence of movement of the bucket is determined by the control unit when the control member 11 is in the actuated state in the direction of a movement of the bucket.

In a more sophisticated version, the control unit 9 is configured to determine, as a function of the control setpoints of the system 8 for driving the movement of the bucket 7, a theoretical travel of movement of the bucket when the control member 11 is in the actuated state and to determine, as a function of the data supplied by the system 12 for detecting the movements of the bucket, a real travel of movement of the bucket. The control unit is also configured to compare the theoretical and real values of travel of movement of the bucket 7 and to reduce the speed of rotation of the heat engine 4 to a value lower than the speed control setpoint value corresponding to the position of the accelerator pedal 10 as a function of the comparison result.

In particular, the control unit is configured to reduce the speed of rotation of the heat engine 4 to a value lower than the speed control setpoint value corresponding to the position of the accelerator pedal when the theoretical value of travel of movement of the bucket 7 is lower than a real value of travel of movement of the bucket 7.

As a variant, or in addition, the control unit 9 is configured to determine, as a function of the control setpoints of the system 8 for driving the movement of the bucket 7, a theoretical speed of movement of the bucket 7 when the control member 11 is in the actuated state and to determine, as a function of the data supplied by the system 12 for detecting the movements of the bucket 7, a real speed of movement of the bucket 7. The control unit 9 is, furthermore, configured to compare the theoretical and real values of speed of movement of the bucket 7 and to reduce the speed of rotation of the heat engine 4 to a value lower than the speed control setpoint value corresponding to the position of the accelerator pedal 10 as a function of the comparison result.

In particular, the control unit is configured to reduce the speed of rotation of the heat engine 4 to a value lower than the speed control setpoint value corresponding to the position of the accelerator pedal 10 when the value of the speed of movement of the bucket 7 is lower than the theoretical value of speed of movement of the bucket 7.

In practice, the operation of such a vehicle 1 is extremely simple. It is assumed that the mode of operation in which the control unit 9 is configured to, as a function of the data supplied by the system 12 for detecting the movements of the bucket 7 and of the control setpoints of the system 8 for driving the movement of the bucket 7, reduce the speed of rotation of the heat engine 4 to a value lower than the speed control setpoint value corresponding to the position of the accelerator pedal 10 is activated. The driver of the vehicle presses on the accelerator pedal 10 to allow the movement of the vehicle 1 toward a heap of loose material and allow the bucket 7 to enter into the material as illustrated in FIG. 1. The driver of the vehicle actuates the control member 11 in the direction of a movement of the bucket 7 to control a digging or a tipping-out of the bucket 7 and/or a lifting or a lowering 81 of the arm and/or an extension or a retraction of the telescope, when this telescope is present. Control setpoints are addressed for this to the system 8 for driving the movement of the bucket 7. The sensors of the system 12 for detecting movement of the bucket measure the observed movements. The control unit 9 compares the characteristics of the real movement of the bucket and the theoretical or expected characteristics of the movement of the bucket linked to the actuation of the control member 11. The control unit 9 reduces the speed of rotation of the heat engine 4 to a speed less than the control setpoint corresponding to the position of the accelerator pedal 10 when the characteristics of the real movement and of the theoretical movement of the bucket illustrate a movement of the bucket 7 that does not conform to the expected movement. The reduction of the engine speed makes it possible to limit the force applied to the wheels of the vehicle and thus relieve the force applied to the bucket 7. When the movement once again conforms to the expected movement, the control unit 9 controls the speed of rotation of the engine 4 with a speed of rotation corresponding to the position of the accelerator pedal 10. Throughout this process, the driver of the vehicle keeps the foot pressed on the accelerator pedal 10. The variations of the engine speed are applied without the intervention of the driver of the vehicle to generate a variable pressure on the accelerator pedal 10. The variation of the engine speed can therefore be applied with the accelerator pedal 10 in the stressed state independently of the position taken by the accelerator pedal. Obviously, the example taken above for a comparison between the theoretical speed and the real speed can likewise be applied to the acceleration or even to the travel of the bucket, or simply to the presence of a movement of the bucket when the control member 11 is the actuated state.

The invention claimed is:

1. A load-handling vehicle comprising: a wheeled chassis, and, supported by said chassis, an internal combustion heat engine, a power transmission mechanism configured to transmit the power of the heat engine to the wheels of the chassis, a bucket, a system for driving the movement of said bucket, a control unit, an accelerator pedal, the control unit being configured to generate a rotation speed control setpoint for the heat engine as a function of the position of the accelerator pedal, a control member that can be manually actuated by the driver of the vehicle, the control unit being configured to generate control setpoints of the system for driving the movement of the bucket as a function of the actuation of the control member, a system for detecting the movements of the bucket with respect to the chassis or to the system for driving the movement of the bucket configured to deliver data representative of the movements of the bucket with respect to the chassis or to the system for driving the movement of the bucket to the control unit, wherein the power transmission mechanism is configured such that a reduction of the speed of rotation of the heat engine causes a lowering of the torque supplied to the wheels of the chassis, where the vehicle comprises at least one mode of operation in which the control unit is configured to, as a function of the data supplied by the system for detecting the movements of the bucket and of the control setpoints of the system for driving the movement of the bucket, reduce the speed of rotation of the internal combustion heat engine to a value lower than the speed control setpoint value corresponding to the position of the accelerator pedal when the detected movements of the bucket do not conform to the control movements of the bucket during a filling operation, wherein the control unit is configured to determine, as a function of the control setpoints of the system for driving the movement of the bucket, any one of a theoretical travel of movement of the bucket, speed of movement of the bucket, or acceleration of movement of the bucket, when the control member is in the actuated state, and to determine, as a function of the data supplied by the system for detecting the movements of the bucket, any one of a real travel of movement of the bucket, speed of movement of the bucket, or acceleration of movement of the bucket, in that the control unit is configured to compare the theoretical and real values of the travel of movement, speed of movement, or acceleration of movement of the bucket and to reduce the speed of rotation of the heat engine to a value lower than the speed control setpoint value corresponding to the position of the accelerator pedal as a function of the comparison result.

2. The load-handling vehicle as claimed in claim 1, wherein the control unit is configured to determine, as a function of the control setpoints of the system for driving the movement of the bucket, the actuation of the control member in the direction of a movement of the bucket and to determine, as a function of the data supplied by the system for detecting the movements of the bucket, a movement or an absence of movement of the bucket, and in that the control unit is configured to reduce the speed of rotation of the internal combustion heat engine to a value lower than the speed setpoint value corresponding to the position of the accelerator pedal when an absence of movement of the bucket is determined by the control unit when the control member is in the actuated state in the direction of movement of the bucket.

3. The load-handling vehicle as claimed in claim 1, wherein the power transmission mechanism is a hydrodynamic power transmission mechanism which comprises a torque converter.

4. The load-handling vehicle as claimed in claim 1, wherein the vehicle comprises a position selector with at least two positions, namely a forward control position and a reverse control position, in that the control member has a neutral position, and in that the mode of operation in which the control unit is configured to, as a function of the data supplied by the system for detecting the movements of the bucket and of the control setpoints of the system for driving the movement of the bucket, reduce the speed of rotation of the heat engine to a value lower than the value delivered by the accelerator pedal is an activatable/deactivatable mode, said mode of operation being deactivated when the position selector is in the reverse control position and the control member is in the neutral position.

5. The load-handling vehicle as claimed in claim 1, wherein the system for driving the movement of the bucket comprises a hydraulic part linked to the internal combustion heat engine.

6. The load-handling vehicle as claimed in claim 1, wherein the system for driving the movement of the bucket comprises at least one arm disposed between the chassis and the bucket, this arm being equipped with at least one first actuator for driving the movement of the arm with respect to the chassis and at least one second actuator for driving the movement of the bucket with respect to the arm between a digging position of the bucket and a tipping-out position, said actuators being linked to a hydraulic pump coupled to the internal combustion heat engine.

7. The load-handling vehicle as claimed in claim 1, wherein the system for detecting the movements of the bucket with respect to the chassis configured to deliver data representative of the movements of the bucket with respect to the chassis or to the system for driving the movement of the bucket to the control unit comprises at least one sensor of the position of the arm with respect to the chassis and one sensor of the position of the bucket with respect to the arm.

* * * * *